US007051822B2

(12) United States Patent
Barry

(10) Patent No.: US 7,051,822 B2
(45) Date of Patent: May 30, 2006

(54) DRILL BIT AND DRILL TIP HAVING A TIP-LOCATING STRUCTURE

(75) Inventor: John Barry, Merewether Hts (AU)

(73) Assignee: Sandvik Intellectual Property AB, Sandviken (SE)

( * ) Notice: Subject to any disclaimer, the term of this patent is extended or adjusted under 35 U.S.C. 154(b) by 204 days.

(21) Appl. No.: 10/808,457

(22) Filed: Mar. 25, 2004

(65) Prior Publication Data

US 2004/0245023 A1 Dec. 9, 2004

(30) Foreign Application Priority Data

Mar. 28, 2003 (AU) ..... 2003203447

(51) Int. Cl.
*E21B 10/36* (2006.01)

(52) U.S. Cl. ..... 175/420.1; 175/417

(58) Field of Classification Search ..... None
See application file for complete search history.

(56) References Cited

U.S. PATENT DOCUMENTS 4,633,959 A 1/1987 Knox
4,688,652 A 8/1987 Crist
5,184,925 A * 2/1993 Woods et al. ..... 408/144
6,309,159 B1 10/2001 Weaver et al.
6,684,968 B1 * 2/2004 Bise et al. ..... 175/427
2002/0195280 A1 12/2002 Bise et al.

* cited by examiner

*Primary Examiner*—Zakiya W. Bates
(74) *Attorney, Agent, or Firm*—Drinker Biddle & Reath LLP

(57) ABSTRACT

A drill bit assembly includes a drill bit having a leading end to which a drill tip is bonded. The drill tip has a front cutting edge, a pair of side cutting edges, a rear end and a pair of parallel side walls extending between the respective edges. The leading end is arranged to support the drill tip along the rear end and against the parallel side walls. The drill bit includes a bore extending axially therethrough and opening into the leading end. The drill tip extends across the bore but permits egress of flushing liquid from the bore. The drill tip includes projections arranged to cooperate with an engagement face formed at the leading end to locate the drill tip in a bonding position relative to the leading end prior to bonding of the drill tip to the leading end. The cooperation is such as to resist shifting movement of the drill tip in a direction of elongation of the tip and out of the bonding position.

12 Claims, 2 Drawing Sheets

Fig. 1
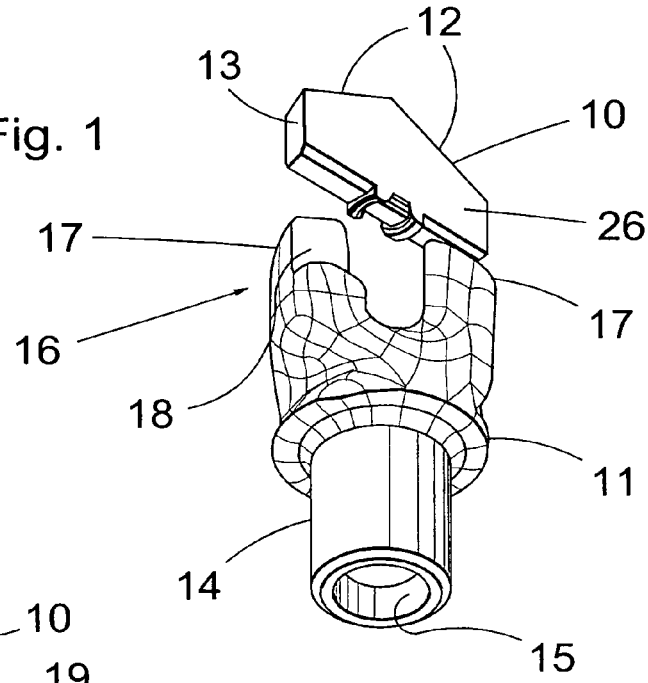
Fig. 2
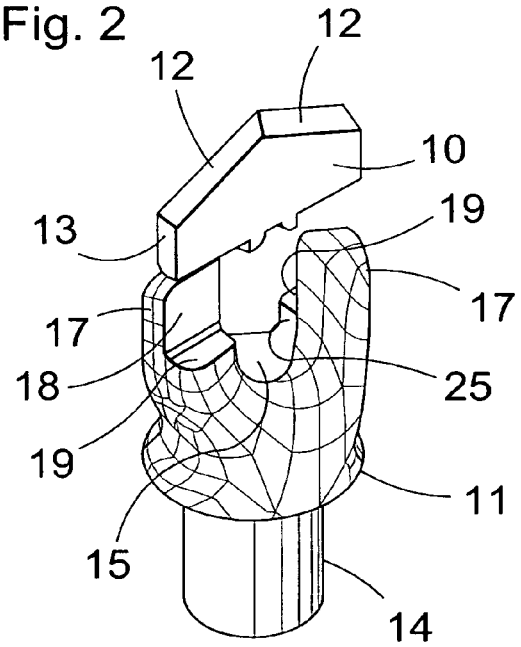
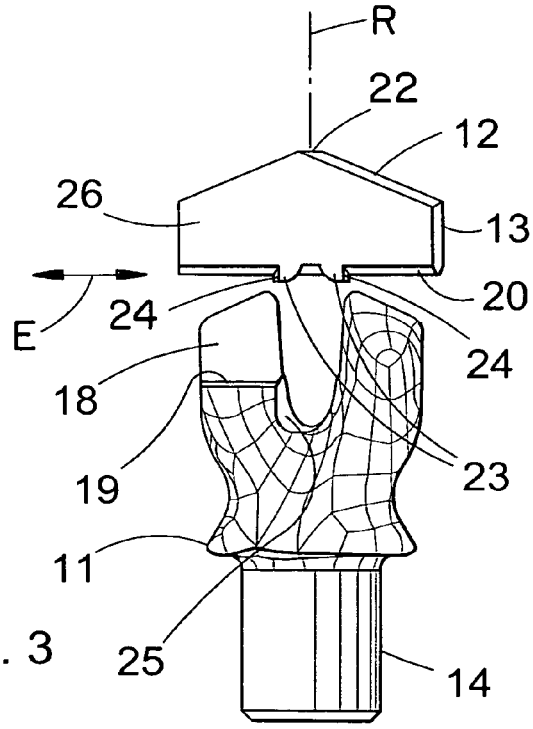
Fig. 3

Fig. 4
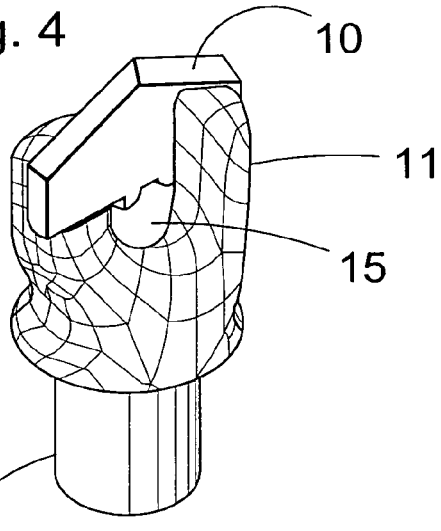
Fig. 5
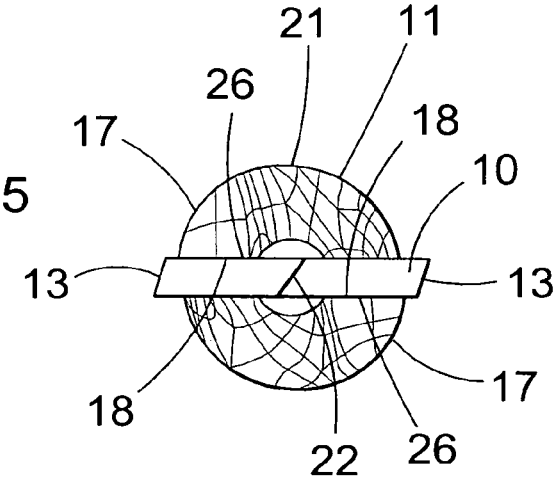
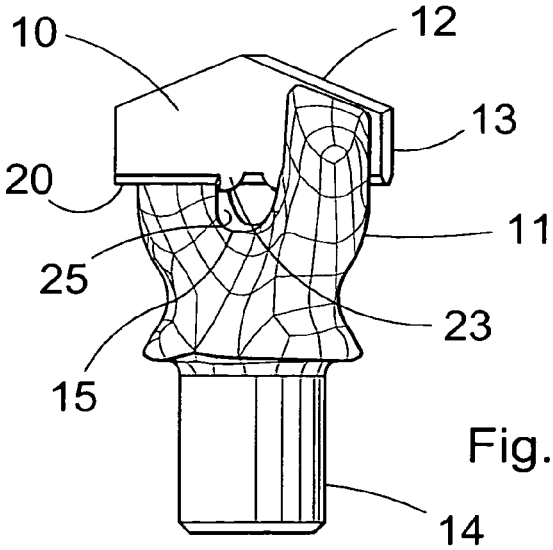
Fig. 6

DRILL BIT AND DRILL TIP HAVING A TIP-LOCATING STRUCTURE

This application claims priority under 35 U.S.C. § 119 to Patent Application Serial No. 2003.203447 filed in Australia on Mar. 28, 2003, the entire content of which is hereby incorporated by reference.

BACKGROUND OF THE INVENTION

The present invention relates to a drill bit, in particular for the drilling of rock. The invention further extends to roof bolts of the self-drilling kind.

Roof bolts are commonly employed in the underground mining industry to support the walls and/or the roof of excavated tunnels and openings against fragmentation and collapse. Roof bolts typically are applied by first drilling a hole in the rock wall and thereafter inserting the roof bolt therein. The bolt is fixed within the hole normally by a settable glue, such as a resin or a mortar cement.

Drill rods typically have a separate drill bit assembly, comprising a drill bit and a cemented carbide tip, which is fixed to the rod at one end thereof. The other end of the rod includes an arrangement for cooperating with a driving assembly, such as a hydraulic or pneumatic drill. The drill bit typically is cast from steel, and machined as required, and a cemented carbide drill tip is fixed to the drill bit, preferably concentrically, and extends normally beyond both the leading end of the drill bit and beyond the side periphery of the bit, to engage the rock and perform the cutting action during a drilling operation.

Typically a drill tip is bonded to one end of the drill bit, by welding, soldering or brazing, with brazing being most common. In the manufacture of a drill bit assembly, the drill tip is located in correct placement relative to the drill bit, whereupon the brazing operation, or other operation as required to bond the tip to the drill bit, is thereafter performed. Unfortunately however, the bonding operation often interferes with the correct placement of the tip relative to the drill bit and the resultant drill bit is formed with the drill tip non-concentrically located relative to the drill bit. While slight non-concentricity error is acceptable, more substantial non-concentricity error generally results in the drill bit being rejected.

Rejection of inaccurately formed drill bits results in a significant expense to drill bit manufacturers and therefore a reduction in that rejection rate is desirable. Also, an improvement in the ease of bonding drill tips to drill bits is additionally desirable.

It is an object of the present invention to overcome, or at least alleviate one or more of the above disadvantages. It is a particular object of the invention, to provide an arrangement, in which the rejection rate of drill bits to which cemented carbide tips are bonded, is lowered.

SUMMARY OF THE INVENTION

One aspect of the present invention relates to a drill bit assembly which includes a drill bit having a leading end to which a drill tip is fixed by bonding. The drill tip has a front cutting edge, and pair of side cutting edges, a rear end, and a pair of parallel side walls. The leading end is arranged to support the rear end and the parallel side walls of the drill tip. The drill bit includes a bore extending axially therethrough and opening into the leading end. The drill tip extends across the bore in a lateral direction permits egress of flushing fluid from the bore. The drill tip includes a locating structure arranged to engage an engagement face structure formed at the leading end of the drill bit to locate the drill tip in a prescribed bonding position relative to the leading end prior to bonding of the drill tip thereto, and to resist shifting movement of the drill tip in the lateral direction out of the prescribed bonding position during bonding of the drill tip.

Another aspect of the invention relates to the drill tip per se which comprises a front end having a pair of front cutting edges, a pair of side cutting edges, a rear end disposed opposite the front end and being elongated in a direction of elongation from one side cutting edge to the other side cutting edge, and a pair of parallel side walls each interconnecting the front and rear ends. The tip defines a center axis of rotation extending trough the front and rear ends in a direction perpendicular to the direction of elongation. The front cutting edges extend from respective side cutting edges in a direction generally away from the rear end and inclined obliquely relative to the axis of rotation as viewed perpendicular to the side walls. The rear end has a locating structure to locate the drill tip in a bonding position prior to being bonded to a drill bit to resist shifting movement of the drill tip in the direction of elongation and out of the bonding position. The locating structure preferably comprises one or more projections extending rearwardly from the rear end.

Accordingly, unless the cooperation between the drill tip and the drill bit fails, the drill tip is reliably positioned relative to the drill bit for bonding thereto. This means that the rejection rate of drill bits on the basis of concentricity error is either eliminated, or substantially reduced.

It is not intended that the cooperation between the drill tip and the drill bit be such as to prevent lifting (axial) movement of the tip away from the drill bit. The cooperation is to prevent lateral shifting movement along the rear end of the drill tip. That is the movement which results in the type of rejection of drill bit assemblies to which the invention is concerned. However, the invention may extend to arrangements that resist lifting movement.

A further advantage of the invention is that the cooperation between the drill tip and the drill bit can increase the strength of the bond formed between those parts, compared to the bond strength of prior art arrangements. The improvement may however be in certain directions only, depending on the type of cooperating arrangement employed.

In a preferred form of the invention, the locating structure includes a projection structure which cooperates with the engagement face of the leading end of the drill bit for securely locating the drill tip relative to the leading end.

In a highly preferred form of the invention, the leading end of the drill bit includes a pair of axially extending abutment elements, each of which includes an abutment face for engagement with an opposite side of the drill tip. The leading end further includes a support face which extends generally laterally from each abutment face for supporting the rear end of the drill tip. Each abutment element further defines a laterally inwardly facing engagement face which extends axially from said support face, and the respective engagement faces are arranged in spaced-apart, opposed facing relationship. The bore which opens into the leading end, is principally for the discharge of flushing medium therethrough, and in use, is aligned with a lengthwise bore formed in a drill rod to which the drill bit assembly is attached. In this preferred embodiment, the support face of each abutment element is axially spaced downstream of the open end of the bore at the leading end, so that the rear end of the drill tip when supported thereon, is spaced from the open end of the bore, so that the drill tip does not obstruct the egress of flushing liquid through the open end. In this embodiment the drill tip includes a rearward projection which cooperates by abutment with the engagement faces of the abutment elements in order to accurately locate the drill tip in the bonding position. In a preferred arrangement, the projection structure of the drill tip extends from the rear end of the tip.

In each of the above embodiments in which either a single engagement face or a pair of engagement faces is provided, each may be formed as an extension of the internal surface of the drill bit bore. Alternatively, the or each engagement face may be formed as part of the internal surface of the drill bit bore, generally at the end of the bore which opens into the leading end. In that arrangement, to ensure that the flushing medium can egress through the bore at the leading end, it is preferable that the thickness of the drill tip is less than the diameter of the bore at the leading end, so that the bore remains open at the leading end despite the drill tip extending laterally across the bore and despite the projection structure extending into the bore to engage the internal surface thereof.

In the above embodiment, the projection structure is constructed to be generally of the same thickness as the thickness of the drill tip measured between the parallel side walls of the tip, and the projection structure further has a length along the bottom edge, which is slightly less than the spacing between the engagement faces.

The projection structure could comprise a single projection. In an alternative embodiment, the drill tip can include a pair of spaced-apart projections extending from the bottom edge, and each of the projections is arranged for engagement respectively with an engagement face. The present invention further extends to drill tips separate from a drill bit, and to drill rods or roof bolts, which have a drill bit assembly of the above described kind. The drill bit assembly can be formed integrally with the drill rod or roof bolt, or can be connected thereto in any suitable manner.

It is to be noted that the invention is applicable to single piece or "spade" type drill tips, as well as to two-piece tips known as "wing tips". It may be however, that the type of cooperating location differs depending on the use of a spade tip or a wing tip. For example, it would be unlikely for a wing tip to include a pair of projections which extend from the bottom edge thereof to engage the internal surface of a bore formed in the drill bit at diametrically opposed positions. More likely, a wing tip will include a single projection extending from the bottom edge, but is may also include a second or more projections as required, that extend elsewhere, such as from a face thereof that abuts against the abutment face. This is an example only, and any arrangement of projections is possible and within the scope of the invention. Likewise, a spade tip may include a single projection, or two or more projections as required.

DESCRIPTION OF THE DRAWINGS

The attached drawings show an example embodiment of the invention of the foregoing kind. The particularity of those drawings and the associated description does not supersede the generality of the preceding broad description of the invention.

FIGS. 1, 2 and 3 show exploded views of a drill bit assembly according to the invention perspectively from the front, perspectively from the rear, and in side elevation, respectively.

FIGS. 4, 5 and 6 show assembled views of the drill bit assembly in front perspective, front view, and side elevation, respectively.

DESCRIPTION OF A PREFERRED EMBODIMENT OF THE INVENTION

The figures show a drill bit assembly comprising a drill tip 10 and a drill bit 11, to which the tip 10 is connected. The drill tip 10 includes a front end having a pair of front cutting edges 12 which are inclined forwardly away from a rear end 20 of the tip, and obliquely relative to a central axis of rotation R, and a pair of side cutting edges 13 extending rearwardly from radially outer ends of the front cutting edges 12. The rear end 20 is situated opposite the front end and is elongated in a direction of elongation E which is oriented perpendicular to the axis of rotation R (see FIG. 3). The tip further includes two parallel side walls 26 each interconnecting the front and rear ends.

The drill bit 11 is formed with a trailing (rear) spigot 14 which is cylindrical and arranged to be fixed in the leading end of a drill rod (not shown). The spigot 14 can include an outer thread for threaded engagement with a drill rod, or it may be otherwise fixed to the drill rod, such as by welding.

The drill bit 11 includes a central bore 15 which extends through the bit 11 and opens into the leading end 16 of the bit 11. The bore 15 is a flushing bore which transports flushing medium to the leading end 16 during a drilling operation, to flush debris from the leading end.

The leading end 16 includes a pair of axially extending abutment elements 17, and each abutment element includes an abutment face 18. The abutment faces face in opposite circumferential directions, and are arranged to engage respective opposite faces of the drill tip 10. This arrangement is most clearly shown in FIG. 5, which shows the drill tip 10, extending fully across the leading (front) end 16 of the drill bit 11 and in contact with each of the abutment faces 18.

Forwardly facing support faces 19 extend generally laterally at the rear base of each of the abutment faces 18, to support the trailing (rear) end 20 of the drill tip 10. One of the support faces 19 is most clearly shown in FIG. 2, while an equivalent support face 19 extends from the other of the abutment elements 17, but in the opposite lateral direction.

In the drill bit assembly, the drill tip 10 is positioned to extend across the drill bit 11 as shown in FIG. 5, so that each of the side edges 13 extends laterally beyond the external periphery 21 of the drill bit 11, and the apex 22 between the cutting edges 12 is generally aligned with the longitudinal axis of the bore 15. Moreover, the drill tip 10 is positioned so that the rear end 20 thereof is supported downstream of the front opening of the bore 15. This arrangement is clearly shown in FIG. 6, in which the rear end 20 of the drill tip 10 is shown spaced from the front opening of the bore 15.

FIG. 5 shows a correctly assembled drill bit 11 with the drill tip 10 in the position described above. In this position, the drill tip 10 is correctly positioned for bonding to the drill bit 11. However, it is the case that correct positioning is difficult to achieve consistently, given that the drill tip 10 in prior art arrangement is not mechanically located relative to the drill bit 11 and therefore can shift relative to the drill bit 11 during handling of the assembly and during the bonding of the drill tip 10 to the drill bit 11. Accordingly, assembled drill bits are often formed in which the apex 22 is not properly aligned with the longitudinal axis of the bore 15 and in such cases, the side cutting edges do not equally extend beyond the periphery 21 of the drill bit 11. In some cases, only one of the side cutting edges 13 extends beyond the periphery 21, and in such cases, the drill bit assembly is required to be rejected by quality control.

According to the embodiment of the invention which is illustrated in the figures, the locating structure comprises a projection structure in the form of at least one rearwardly extending projection but more preferably in the form of a pair of locating projections 23 which extend rearwardly from the rear end 20 of the drill tip 10. Each projection has a laterally outwardly facing outer edge 24 which is positioned to engage against a corresponding engagement face 25 which extends forwardly from the inside surface of the bore 15 and which forms a laterally inwardly facing surface of each abutment element 17. One engagement face 25 is shown in FIG. 2, while an opposed engagement face 25 is shown in FIG. 3. The assembled arrangement is most clearly shown in FIG. 6, in which the left hand projection 23 is shown snugly engaging against the respective engagement face 25. It will be clear from the figures, that when the drill tip 10 is placed in the correct bonding position shown in FIG. 5, that the laterally outwardly facing outer edges 24 (FIG. 3) of the projections 23, engage respective engagement faces 25 at diametrically opposed positions. That engagement restrains the tip 10 from shifting laterally along the rear end of the tip 20 in the direction of elongation E, which would shift the apex 22 out of alignment with the axis of the bore 15, and therefore the drill tip 10 is accurately positioned and is unlikely to shift to an inaccurate position.

The main requirement for fixing the position of the drill tip 10 relative to the leading end 16, is to eliminate lateral movement of the drill tip 10 during the brazing operation. The arrangement shown in the drawings facilitates this, although it is acceptable that the projections 23 loosely engage the engagement faces 25 as very slight lateral movements of the drill tip 10 are acceptable. What is not acceptable is larger lateral movements which cause the drill tip 10 to be substantially misaligned relative to the drill bit 11. Thus, it will be appreciated that the projections define a length of the projection structure which is measured as the distance between the two laterally outwardly facing edges 24. That length can be slightly less than the distance between the two engagement faces 25.

It will be appreciated that a wide variety of different arrangements can be adopted to achieve the result of the embodiment shown in the drawings. Accordingly, while two projections 23 are shown, a single projection 23 which engages only one engagement face may be acceptable. Therefore, a wide variety of mating arrangements can be provided. The illustrated embodiment however is particularly advantageous, because it requires minimum change to existing arrangements, and the change which is made to the drill tip, to introduce each of the projections 23, is relatively simple.

The invention described herein is susceptible to variations, modifications and/or additions other than those specifically described and it is to be understood that the invention includes all such variations, modifications and/or additions which fall within the spirit and scope of the above description.

What is claimed is:

1. A drill bit assembly including a drill bit having a leading end to which a drill tip is fixed by bonding, said drill tip having a front cutting edge, a pair of side cutting edges, a rear end, and a pair of parallel side walls, said leading end being arranged to support said rear end and said parallel side walls of said drill tip, said drill bit including a bore extending axially therethrough and opening into said leading end, said drill tip extending across said bore in a lateral direction and permitting egress of flushing liquid from said bore, said drill tip including a locating structure arranged to engage an engagement face structure formed at said leading end of said drill bit to locate said drill tip in a prescribed bonding position relative to said leading end prior to bonding of said drill tip to said leading end, and to resist shifting movement of said drill tip in said lateral direction out of said prescribed bonding position during bonding of the drill tip.

2. A drill bit assembly according to claim 1, said locating structure comprising a rearward projection structure.

3. A drill bit assembly according to claim 2, said leading end including a pair of axially extending abutment elements each of which includes an abutment face for engaging and supporting a respective one of said side walls, and a support face extending generally laterally from each said abutment face for supporting said rear end of said drill tip, said abutment elements defining respective engagement faces together forming said engagement face structure, each engagement face facing laterally inwardly and extending axially from said support face, said engagement faces being spaced-apart in opposed facing relationship, said projection structure extending from said rear end of said drill tip for engagement with said engagement faces.

4. A drill bit assembly according to claim 3, wherein said projection structure is generally of the same thickness as said drill tip as measured between said side walls, said projection structure defining two laterally outwardly facing edges, a distance between said outwardly facing edges being slightly less than the spacing between said engagement faces.

5. A drill bit assembly according to claim 3, said projection structure including a pair of laterally spaced-apart projections extending from said lower end, said projections engaging respectively against said engagement faces.

6. A drill bit assembly according to claim 1, said engagement face structure, being formed as an extension of an internal surface of said bore.

7. A drill bit assembly according to claim 1, said engagement face structure being formed by an internal surface of said bore.

8. A drill bit assembly according to claim 7, wherein said locating structure extends from said rear end and engages respective diametrically opposed engagement faces which together constitute the engagement face structure.

9. A drill bit assembly according to claim 8, wherein a thickness of said drill tip is less than a diameter of a leading end of said bore.

10. A drill bit assembly according to claim 7, wherein the locating structure comprises a pair of spaced apart projections.

11. A drill tip for a drill bit, comprising a front end having a pair of front cutting edges, a pair of side cutting edges, a rear end disposed opposite the front end and being elongated in a direction of elongation from one side cutting edge to the other side cutting edge, and a pair of parallel side walls each interconnecting the front and rear ends, the tip defining a center axis of rotation extending through the front and rear ends in a direction perpendicular to the direction of elongation, the front cutting edges being inclined obliquely relative to the axis of rotation in a direction generally away from the rear end and being inclined obliquely relative to the axis of rotation as viewed perpendicularly to the side walls, said rear end having a projection structure extending rearwardly from said rear end to locate said drill tip in a bonding position prior to being bonded to a drill bit, to resist shifting movement of said drill tip in said direction of elongation and out of the bonding position.

12. A drill tip according to claim 11, wherein said projection structure comprises a pair of projections spaced apart in the direction of elongation.

* * * * *